United States Patent [19]

Colson

[11] Patent Number: 4,498,984

[45] Date of Patent: Feb. 12, 1985

[54] SWIMMING POOL APPARATUS

[76] Inventor: Andrew E. Colson, 22 Way Dr., Summit, N.J. 07901

[21] Appl. No.: 116,764

[22] Filed: Jan. 30, 1980

[51] Int. Cl.[3] ..... C02F 1/00

[52] U.S. Cl. ..... 210/122; 210/169

[58] Field of Search ..... 210/169, 121, 122; 4/507, 508, 509; 137/563, 574, 576; 415/501

[56] References Cited

U.S. PATENT DOCUMENTS

| | | | |
|---|---|---|---|
| 2,347,092 | 4/1944 | Evans | 210/169 |
| 2,579,304 | 12/1951 | Crawford | 210/169 |
| 2,739,939 | 3/1956 | Leslie | 4/509 |
| 2,979,206 | 4/1961 | Konopka et al. | 210/169 |
| 3,143,499 | 8/1964 | Miller | 210/169 |
| 3,252,576 | 5/1966 | Miller | 210/169 |
| 3,288,294 | 11/1966 | Frey | 210/169 |
| 3,297,163 | 1/1967 | Landon | 210/169 |
| 3,372,809 | 3/1968 | Spitzor | 210/169 |
| 3,512,646 | 5/1970 | Willinger | 210/169 |
| 3,515,495 | 6/1970 | Blum | 415/501 |
| 3,532,217 | 10/1970 | Richards | 210/169 |
| 3,633,749 | 1/1972 | Panish | 210/169 |
| 3,759,389 | 9/1973 | Valois et al. | 210/169 |
| 3,859,214 | 1/1975 | Lang et al. | 210/169 |
| 3,864,262 | 2/1975 | Lang et al. | 210/169 |
| 3,916,458 | 11/1975 | Ogdon | 4/509 |
| 4,133,058 | 1/1979 | Baker | 4/508 |

*Primary Examiner*—Ivars Cintins

*Attorney, Agent, or Firm*—Hopgood, Calimafde, Kalil, Blaustein & Judlowe

[57] ABSTRACT

Improved swimming pool apparatus includes contiguous, separate pool and secondary water chambers. The secondary chamber receives pool surface water via a skimmer weir regulated by the main pool water level, and via a pool main drain coupling. A cascaded, submersed filter and pump cleans and returns water to the pool.

The apparatus need not be winterized and provides water recirculation and cleaning—even in the presence of surface ice; utilizes pump waste heat for water heating; and assures both pool and pool water cleaning during normal operation.

4 Claims, 4 Drawing Figures

SWIMMING POOL APPARATUS

DISCLOSURE OF THE INVENTION

This invention relates to swimming pools and, more specifically, to an improved swimming pool having a secondary water chamber which includes a submerged pump and filter for purposes below discussed.

A typical prior art closed circulation swimming pool is shown in FIG. 1 and includes a pool 10 having a skimmer 15 and main drain 12 connected via conduits 25 and 13 to a pump and filter. The filtered water is returned via a pipe 31 to the pool at orifice 32. The skimmer 15 is conventionally disposed in an aperture near the top of one pool wall, and includes a plate 17 pivoted 20 at its lower end, and positioned via rear float 18 so that its upper edge is at some point beneath the pool water surface dependent upon the water level behind plate 16 (as sensed by float 18). Thus, the higher the water behind weir plate 17, the more vertically oriented the plate and the less pool water is permitted to flow over the upper edge of plate 17.

The prior art FIG. 1 pool may be of several forms. Thus, pool 10 has been in or above-ground, with an above-ground pump and filter 30. A pool 10 has sometimes been formed of a liner floated in a lake to define a "clean" swimming area, and the pool water recycled by a submersed pump.

It is an object of the present invention to provide pool apparatus characterized by improved operational features vis-a-vis prior art pools.

More specifically, it is an object of the prior art to provide a convenience swimming pool which need not be winterized, i.e., which obviates the possibility of above-ground pipe/pump/filter water freezing. Such freezing at least disables operation (and concomitant pool cleaning)—and possibly causes freeze-expansion bursting damage as well.

It is another object of the present invention to utilize pump waste heat, lost in prior art arrangements, to pool water heating.

It is further object of the present invention to provide a non-leaking pool with self-contained piping; and which automatically backwashes the pool filter when the pump is deenergized.

It is yet another object of the present invention to provide improved surface water filtering weir apparatus which is responsive to the pool water level, and which thus limits the surface water level upon, and contribution to pool filtering equipment.

The above and other features and advantages of the present invention are realized in a specific, illustrative composite swimming pool which includes contiguous, separate pool and secondary water chambers. The secondary chamber receives pool surface water via a skimmer weir regulated by the pool water level, and via a pool main drain coupling. A cascaded, submersed filter and pump cleans and returns water to the pool.

The apparatus need not be winterized and provides water recirculation and cleaning—even in the presence of surface ice; utilizes pump waste heat for water heating; and assures both pool and pool water cleaning during normal operation.

The above and other features and advantages of the present invention are realized in a specific, illustrative embodiment thereof, presented hereinbelow in conjunction with the accompanying drawing, in which.

Figure 1:
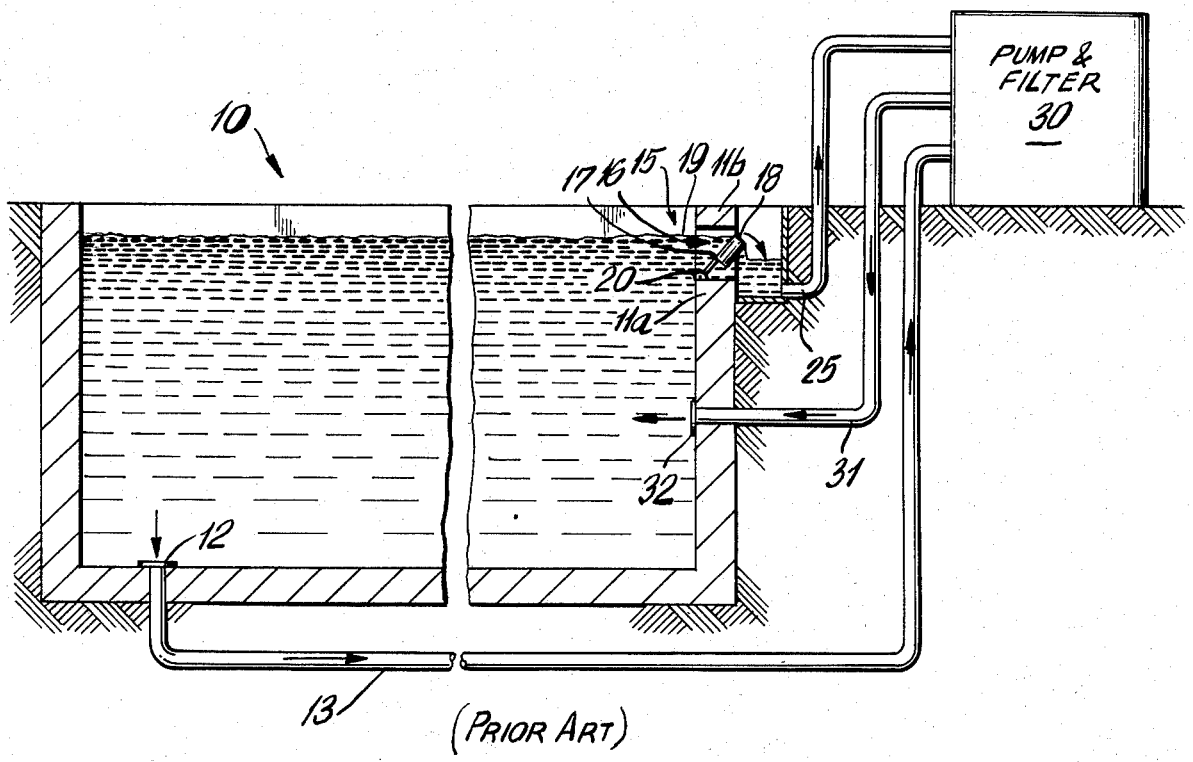
FIG. 1 depicts prior art pool apparatus as above-discussed.
Figure 2:
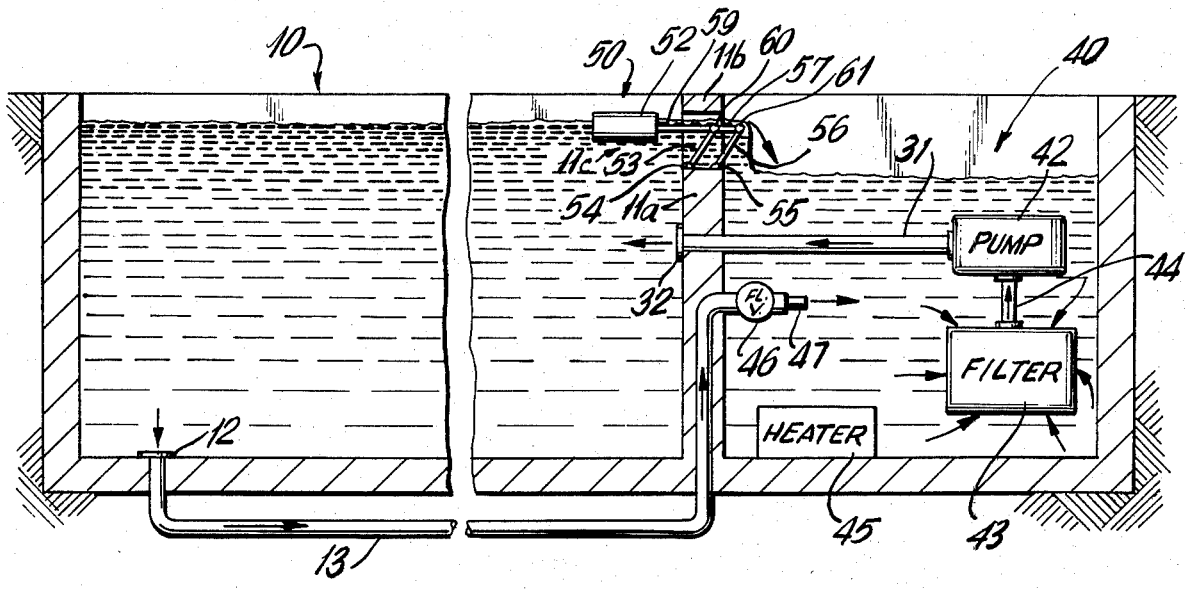
FIG. 2 depicts a first embodiment of improved swimming pool apparatus illustrating the principles of the present invention.
Figure 4:
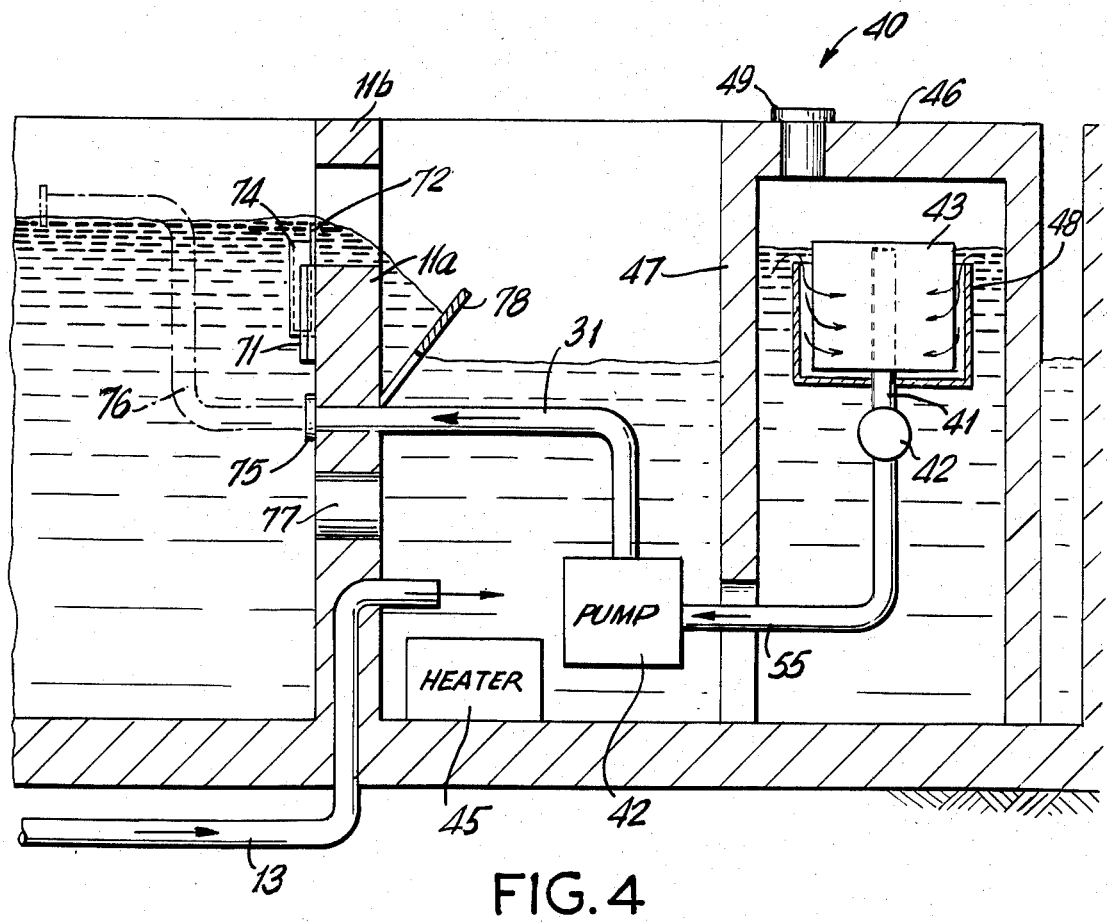
FIG. 4 illustrates a second embodiment of improved swimming pool apparatus illustrating the principles of the present invention.

Like numerals identify like elements in the implementations of FIGS. 1, 2 and 4.

Referring now to FIG. 2, there is shown improved swimming pool apparatus of the present invention which includes a main water containing swimming pool chamber 10 (shown below grade) connected via a common wall 11 to a secondary and substantially smaller water containing chamber 40. A conduit, or pipe 13, connects a main drain 12 at the bottom of the pool 10 with an exit nozzle 47 for delivering main pool water to the secondary chamber 40, the flow through the pipe being controlled by a valve 46 discussed below.

The common wall 11 connecting the main and secondary water chambers 10 and 40 includes an aperture 11*c* which includes weir apparatus 50 for permitting only the surface water from the main pool to flow over a plate 59 into the secondary chamber 40 (the surface water containing oils, films and other relatively light (vis-a-vis water density) materials to be purged from the main pool). To clean relatively heavier waste collecting at the pool 10 bottom, it is desirable that the water level in the secondary pool be controlled by the valve 46 (and to be independent of the main pool water level) to assure a substantial pool 10 bottom-cleaning water flow through the main drain 12 and pipe 13. All water in the chamber 40 is cleansed and returned to pool 10 via a filter 43 and pump 42 below discussed.

Accordingly, in accordance with one aspect of the instant invention, the surface water skimming apparatus 50 in the FIG. 2 embodiment is controlled by the water level in the main pool 10 and not by any water level behind apparatus 50. This limits water flow over the weir plate to only the surface level which carries light contaminants—thereby also assuring that the principal water filter recirculation is via the pool main drain for pool water cleansing purposes. To this end, the composite weir apparatus employed includes plates 53 and 56, respectively, connected to the surface plate 59 and the lower common wall portion 11*a* at pivots 60 and 54, and 61 and 55, respectively. A float 52 senses the water level in the main pool and controls the height of skimmer plate 59 to a level just below the main pool surface water. Float 52 may thus be connected directly to the plate 59 as shown, or may be so connected by a mechanical linkage. Plates 53 (principally) and 56 substantially block water from flowing from the main pool 10 through the wall aperture 11*c* into the secondary chamber 40. The skimmer 50 thus principally passes only pool surface water above the horizontal weir surface 59 as desired.

The composite structure 50 is merely illustrative of main pool 10 level sensing apparatus apparent to those skilled in the art. A simple float adapted to vertically translate with the main pool water level, and coupled to a pivoted inclined plate 53, will suffice. Indeed in its simplest implementation, skimming may be effected by simply fixing the height of the upper surface of common wall 11*a*, and controlling the water level in the main pool by a water level responsive valve of any description, e.g., a float control for water intake and discharge valves.

The secondary chamber 40 includes a submerged water filter 43, e.g., a surface water ingress filter in which water in the chamber 40 enters the filter through its surface periphery under suction action applied to the interior filter 43 by the pump 42 through a conduit 44. Surface filter 43 may be of any type well known to those skilled in the art, e.g., one employing a diatamaceous earth active material about a septum (i.e., a porous structure). The discharge side of the pump 42 is connected via conduit 31 through the common interchamber wall 11 and discharges into the main pool 10 at orifice 32.

The water level in the secondary chamber 40 is maintained at a prescribed level (beneath that of the main pool 10) by valve 46 which controls the water flow from the main pool 10 main drain 12 into the chamber 40. The valve 46, again, may comprise any valve apparatus well known to those skilled in the art for controlling a water level, e.g., a float level controlled by a chamber 40 surface level sensing float, a pressure depth (sensing) element, or the like. Finally, the secondary chamber, if desired, may include a supplemental heater 49.

In use, the main pool level—responsive weir apparatus 50 produces a relatively constant flow of surface fluid passing from the main pool into the secondary chamber 40. The remaining (and major part) of the fluid in the secondary chamber 40 is drawn via main drain 12 from the bottom portion of the pool via pipe 13 (thus, maintaining an active circulation about the lower part of pool 10 thereby constantly cleaning the pool). The fluid in secondary chamber 40 passes into and through the diatamaceous earth filter 43 where it is cleansed and is returned via conduits 44 and 31 and pump 42 into the main pool. Thus, the FIG. 2 apparatus provides a complete and fully operative pool assembly.

Several observations are noted at this point. First, all of the waste heat generated in submersed pump 42 is employed to heat the pool water while it reposes in the secondary chamber 40 prior to recirculation and return to the main pool 10. This is in direct contrast to the FIG. 1 apparatus wherein heat generated in pump 30 is simply lost to the ambient environment. Secondly, the pump 42, filter 43, and the circulation path therefor is all submerged and will not freeze in all but the most hostile environments. Thus, active water circulation via the main pool main drain and pipe 13 will continue (as will its concomitant pool cleaning action)—even in the presence of surface ice. Thus, pools need not even be covered, which presents a distinct advantage in user convenience. The consequences of all this is to obviate the need for pool winterization—a substantial manual and economical cost to a user. Finally, when pump 42 is turned off, the backwash of fluid from main pool 10 into orifice 32 and through pipes 31 and 44 will backwash and automatically clean the filter 43.

Figure 3:
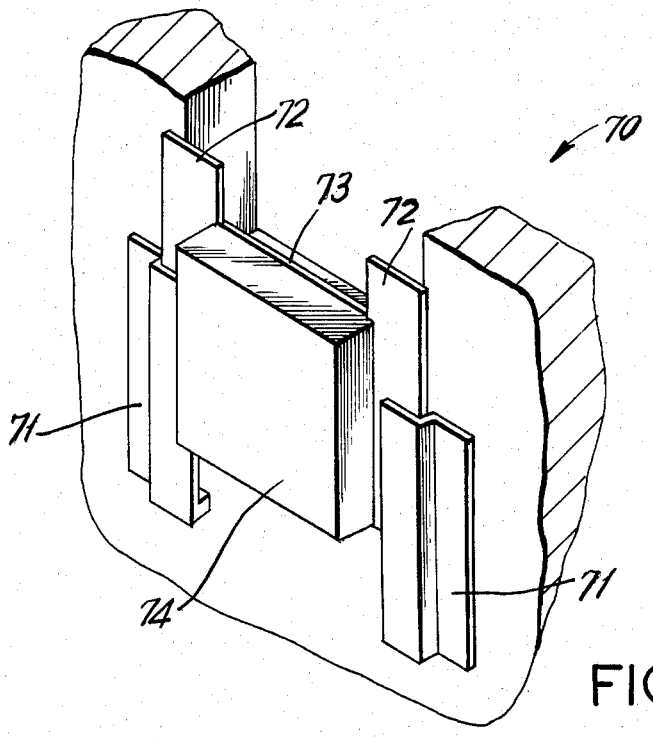
FIG. 3 illustrates variable-positioned weir apparatus for pool surface water filtering in the FIG. 4 embodiment.

Turning now to the second illustrative embodiment of the present invention illustrated in FIG. 3 (variable-positioned weir 70 only) and FIG. 4, like reference numerals identify corresponding elements in FIGS. 2 and 4. Indeed, the embodiment of FIG. 4 will be discussed only briefly—there being a very large overlap in structure and functioning of the primary and secondary pools 10 and 40, common wall 11, main drain 12 and conduit 13, filter 43, pump 42 and discharge conduit 55, heater 45 and the like. As one principal difference, the FIG. 4 embodiment includes an inverted dome 47 providing an enclosed, water sealed cavity about the filter 43 in the secondary chamber 40. The header 42 is below the filter 43 and communicates with the filter via at least one standpipe 43 having its open input end about the top of the filter 43. The standpipe 41 thus removes all air bubbles which reach the top area of dome 47 and assures that the water level in the inverted dome 47 is at the top of filter 43 which thus utilizes its full active filtering area. Also employed in the FIG. 4 filter apparatus is a water shield plate 48 which mechanically protects filter 43; and which forces water flow up and around the upper plate edge. This enhances full use of the filter surface and also reduces the relatively heavy particulate which reaches the filter. A plug 49 may be withdrawn to communicate atmospheric pressure to the top of dome 47, facilitating its removal and access to the dome inter elements.

As further matters, the composite weir apparatus 70 in the embodiments of FIGS. 3 and 4 includes a plate 72 with a lowered middle top surface 73 and a rear pad or layer of a flotation material 74. In keeping with the desideratum earlier expressed with respect to the embodiment of FIG. 2, the weir apparatus 70 in the alternative form of FIGS. 3 and 4 is adapted to position the edge slightly below (for example, one-half inch) the level of the water obtaining in pool 10—irrespective of that level. This will ensure that only a limited amount of surface water passes to the secondary pool 40 such that the main part of the filter circulation is drawn through the main drain 12 and conduit 13 assuring continuous pool cleaning via the main drain. The weir 70 plate 72 is adapted to vertically slide in a track 71 which has a bottom stop to limit the downward travel of the composite weir plate 72 with its attendant flotation 74. Also, a splash-reducing plate 78 is disposed behind the weir apparatus 70 to reduce water splashing, thereby also reducing noise and air bubbles.

In practice, the pump 42 is periodically turned off, e.g., once each evening. With the pump off, water in the main chamber 10 and secondary chamber 40 equalizes in level via the main drain 12 and conduit 13 by normal hydrostatic action. With the water levels equalized and water on either side of the weir laminate 72–74, the plate 72–74 floats vertically in track 70 to its predetermined position with the edge 73 slightly below the water level in the main pool 10. When the pump 42 is again turned on, water is forced by pump 42 from the secondary pool 40 back into the main pool 10, lowering the level in the secondary pool 40 (but not materially changing the level in the main pool 10 in view of the markedly different size of the pools 10 and 40). With water on the main pool side of the laminate 72–74 but not on the secondary pool side, the hydrostatic pressure operating against the left (in FIGS. 3 and 4) surface of the laminate 72–74 force the weir plate against the wall 11 preventing its vertical travel such that the weir plate maintains its position with edge 73 slightly below the water level obtaining in main pool 10 whatever that level happened to be when the pump was last deactivated.

As a further and optional matter, a conduit 76, shown dashed in FIG. 4, is connected to the discharge side of pipe 51 via a rotatable coupling 75. The conduit 76 may be in its raised position as shown to provide a surface water flow against which a swimmer in the main pool may work for exercise purposes while swimming in place. By merely rotating the conduit 76 to a downward position at the rotating coupling 75, the pump-recirculated water exiting from conduit 76 merely re-enters the main pool 10 at some lower submerged level in a routine manner. The conduit 76 and couplet 75 may also be utilized presently in the embodiment of FIG. 2. It will be appreciated that the FIGS. 3 and 4 embodiment enjoys all of the advantages above discussed with respect to the FIG. 2 implementation—as well as the improved weir and filtering performance above discussed.

Also, the composite filter and circulation organization of FIG. 4 may be utilized in FIG. 2 and vice versa. Further, water is disposed on both sides of inter chamber wall 40 and thus some small leakage about elements through the wall 11 poses no difficulty. In this regard, the wall 11 may include one or more lights 77.

The above described arrangement is merely illustrative of the principles of the present invention. Numerous modifications and adaptations thereof will be readily apparent to those skilled in the art without departing from the spirit and scope of the present invention.

What is claimed is:

1. In combination in swimming pool apparatus, a primary swimming pool chamber, a secondary water chamber, skimmer means for passing surface water from said primary swimming pool chamber to said secondary chamber, wherein said skimmer means comprises a first pivotably mounted plate, a second pivotably mounted plate, and further horizontally disposed plate means pivotably connected to said first and second plates, means responsive to the water level in said primary swimming pool chamber for controlling the position of said first plate, drain and conduit means about the lower portion of said primary pool chamber for supplying water from said primary pool chamber to said secondary chamber, and cascaded filter means and pump means submerged in said secondary chamber for returning water passing through said filter means to said primary swimming pool chamber.

2. In combination in swimming pool apparatus, a primary swimming pool chamber, a secondary water chamber, skimmer means for passing surface water from said primary swimming pool chamber to said secondary chamber, wherein said skimmer means comprises a first pivotably mounted plate, a second pivotably mounted plate, and further horizontally disposed plate means pivotably connected to said first and second plates, means responsive to the water level in said primary swimming pool chamber for controlling the portion of said first plate, drain and conduit means about the lower portion of said primary pool chamber for supplying water from said primary pool chamber to said secondary chamber, valve means connected to said drain and conduit means for regulating the water level in said secondary chamber, and cascaded filter means and pump means submerged in said secondary chamber for returning water passing through said filter means to said primary swimming pool chamber.

3. In combination in swimming pool apparatus, a primary swimming pool chamber, a secondary water chamber, skimmer means for passing surface water from said primary swimming pool chamber to said secondary chamber, wherein said skimmer means includes a skimmer plate mounted for vertical translation, and flotation means responsive to the water level in said primary swimming pool for selectively vertically positioning said skimmer plate, drain and conduit means about the lower portion of said primary pool chamber for supplying water from said primary pool chamber to said secondary chamber, and cascaded filter means and pump means submerged in said secondary chamber for returning water passing through said filter means to said primary swimming pool chamber.

4. In combination in swimming pool apparatus, a primary swimming pool chamber, a secondary water chamber, skimmer means for passing surface water from said primary swimming pool chamber to said secondary chamber, wherein said skimmer means includes a skimmer plate mounted for vertical translation, and flotation means responsive to the water level in said primary swimming pool for selectively vertically positioning said skimmer plate, drain and condiut means about the lower portion of said primary pool chamber for supplying water from said primary pool chamber to said secondary chamber, and cascaded filter means and pump means submerged in said secondary chamber for returning water passing through said filter means to said primary swimming pool chamber, wherein said secondary chamber includes an enclosure having a fluid communication orifice with said secondary chamber, and wherein said filter is included in said enclosure.

* * * * *